US005553377A

United States Patent [19]

Hirano et al.

[11] Patent Number: 5,553,377

[45] Date of Patent: Sep. 10, 1996

[54] METHOD OF MAKING REFRIGERANT TUBES FOR HEAT EXCHANGERS

[75] Inventors: Hirosaburo Hirano; Yuji Yamamoto; Shinji Ito, all of Tochigi, Japan

[73] Assignee: Showa Aluminum Corporation, Sakai, Japan

[21] Appl. No.: 283,504

[22] Filed: Aug. 1, 1994

Related U.S. Application Data

[62] Division of Ser. No. 77,069, Jun. 16, 1993.

[30] Foreign Application Priority Data

Mar. 26, 1993 [JP] Japan ..... 5-068578

[51] Int. Cl.[6] ..... B23P 15/00

[52] U.S. Cl. ..... 29/890.053; 29/890.045; 29/890.049

[58] Field of Search ..... 29/890.045, 890.049, 29/890.053; 165/170, 177, 181, 183; 138/170, 171, 172

[56] References Cited

U.S. PATENT DOCUMENTS 5,172,476 12/1992 Joshi ..... 29/890.053
5,184,672 2/1993 Aoki ..... 165/109.1
5,186,250 2/1993 Ouchi et al. ..... 165/177

FOREIGN PATENT DOCUMENTS 174696 10/1982 Japan .

*Primary Examiner*—Irene Cuda
*Attorney, Agent, or Firm*—Armstrong, Westerman, Hattori, McLeland & Naughton

[57] ABSTRACT

A refrigerant tube for use in heat exchangers comprises a flat aluminum tube having parallel refrigerant passages in its interior and comprising flat upper and lower walls and a plurality of reinforcing walls connected between the upper and lower walls, extending longitudinally of the tube and spaced apart from one another by a predetermined distance. The reinforcing walls are each formed with communication holes for causing the parallel refrigerant passages to communicate with one anther therethrough. The flat aluminum tube is prepared from upper and lower two aluminum sheets by bending opposite side edges of the lower aluminum sheet to a raised form and joining the bent edges to the respective side edges of the upper aluminum sheet which is flat so as to form a hollow portion. The reinforcing walls are formed by joining to the inner surface of the upper wall ridges projecting inward from the lower wall. The communication holes are formed by cutouts formed in the edges of the ridges at a predetermined spacing and having their openings closed with the upper wall.

7 Claims, 8 Drawing Sheets

METHOD OF MAKING REFRIGERANT TUBES FOR HEAT EXCHANGERS

This is a division, of application Ser. No. 08/077,069 filed Jun. 16, 1993.

BACKGROUND OF THE INVENTION

The present invention relates to tubes for passing a refrigerant therethrough, i.e., refrigerant tubes, for heat exchangers, and more particularly to refrigerant tubes for condensers for use in car coolers.

The term "aluminum" as used herein and in the claims includes pure aluminum and aluminum alloys.

Examined Japanese Patent Publication No. 45300/91 discloses a condenser for use in car coolers which comprises a pair of headers arranged at right and left in parallel and spaced apart from each other, parallel flat refrigerant tubes each joined at its opposite ends to the two headers, corrugated fins arranged in an air flow clearance between adjacent refrigerant tubes and brazed to the adjacent refrigerant tubes, an inlet pipe connected to the upper end of the left header, an outlet pipe connected to the lower end of the right header, a left partition provided inside the left header and positioned above the midportion thereof, and a right partition provided inside the right header and positioned below the midportion thereof, the number of refrigerant tubes between the inlet pipe and the left partition, the number of refrigerant tubes between the left partition and the right partition and the number of refrigerant tubes between the right partition and the outlet pipe decreasing from above downward. A refrigerant flowing into the inlet pipe in a vapor phase flows zigzag through the condenser before flowing out from the outlet pipe in a liquid phase. Condensers of the construction described are called parallel flow or multiflow condensers, realize higher efficiencies, lower pressure losses and supercompactness and are in wide use recently in place of conventional serpentine condensers.

It is required that the flat refrigerant tube for use in the condenser have pressure resistance since the refrigerant is introduced thereinto in the form of a gas of high pressure. To meet this requirement and to achieve a high heat exchange efficiency, the refrigerant tube is made of a hollow aluminum extrudate which comprises flat upper and lower walls, and a reinforcing wall connected between the upper and lower walls and extending longitudinally. To improve the heat exchange efficiency and to compact the condenser, it is desired that the flat refrigerant tube have a small wall thickness and the lowest possible height. In the case of extrudates, however, the extrusion technique improses limitations on the reduction in the height of the tube and in the wall thickness.

The reinforcing wall in the refrigerant tube forms independent parallel refrigerant passages in the interior of the tube. Air flows orthogonal to the parallel refrigerant passages, so that the heat exchange efficiency is consequently higher at the air inlet side than at the air outlet side. Accordingly, gaseous refrigerant is rapidly condensed to a liquid in the refrigerant passage at the upstream side, whereas the refrigerant still remains gaseous in the refrigerant passage at the downstream side. When the entire structure of refrigerant tube is considered, the refrigerant therefore flows unevenly, failing to achieve a high heat exchange efficiency.

To overcome this problem, Unexamined Japanese Patent Publication No. 98896/89 discloses a flat refrigerant tube provided by an electric resistance welded tube. The disclosed refrigerant tube is internally divided into a plurality of refrigerant passages and has louvered wavelike inner fins inserted in and brazed to the tube for causing the refrigerant to flow between adjacent passages. Unexamined Japanese Patent Publication No. 136093/82 discloses an electric resistance welded flat refrigerant tube which is formed on its upper and lower walls with inwardly projecting reinforcing portions butting against each other end-to-end and shaped to a folded-in-two form, the reinforcing portions being arranged discretely in parallel longitudinally of the tube.

However, the former flat refrigerant tube is low in productivity since the wavelike inner fins need to be individually inserted into the tube. With the latter flat refrigerant tube in which the inwardly projecting reinforcing portions are formed by press work or rolling, the reinforcing portions have a V-shaped open cross section and are therefore insufficient in strength. Although the inwardly projecting reinforcing portions may be formed by rolling, this method inevitably leaves streaklike grooves in the upper and lower walls of the tube, so that when the tube is joined to the headers in communication therewith by brazing, the brazing agent is likely to flow out along the groove from the joint portion to be formed to produce a defective joint. Further provision of discrete reinforcing portions in the folded form on a flat sheet is likely to involve variations in dimensions to form refrigerant passages which are not uniform in size. Additionally since the material sheet remains unchanged in thickness when roll forming is resorted to, it is disadvantageous from the viewpont of the material to form the reinforcing portions by folding in two, while difficulty is encountered in forming many refrigerant passages of reduced width.

The main object of the present invention is to provide a refrigerant tube for use in heat exchangers which achieves a high heat exchange efficiency, is sufficient in pressure resistance and can be produced efficiently.

SUMMARY OF THE INVENTION

To fulfill the above object, the present invention provides a refrigerant tube for use in heat exchangers which comprises a flat aluminum tube having parallel refrigerant passages in its interior and comprising flat upper and lower walls and a plurality of reinforcing walls connected between the upper and lower walls, the reinforcing walls extending longitudinally of the tube and spaced apart from one another by a predetermined distance, the flat aluminum tube being formed by an aluminum sheet, each of the reinforcing walls comprising a ridge projecting from the aluminum sheet integrally therewith.

The reinforcing walls are each formed with a plurality of communication holes for causing the parallel refrigerant passages to communicate with one another therethrough. The refrigerant to be passed through the parallel refrigerant passages flows through the communication holes widthwise of the refrigerant tube to spread to every portion of all the refrigerant passages, whereby portions of the refrigerant become mixed together. Accordingly, no temperature difference occurs in the refrigerant between the refrigerant passages, with the result that the refrigerant undergoes condensation similarly at the upstream side and the downstream side with respect to the direction of passage of air to flow uniformly and achieve an improved heat exchange efficiency.

The flat aluminum tube is formed by an aluminum sheet, and the reinforcing walls each comprise a ridge projecting from and integral with the aluminum sheet, so that cutouts for providing the communication holes can be formed in the ridge. Consequently, the refrigerant tube is available with much higher productivity than the refrigerant tube which comprises the combination of an electric resistance welded tube and louvered inner fins. The present tube can be made smaller in its wall thickness and in the height of the tube than refrigerant tubes made of aluminum extrudate. This makes it possible to provide heat exchangers of improved performance and reduced weight.

Furthermore, a brazing sheet is usable as the aluminum sheet for forming the flat aluminum tube. This eliminates the need to use brazing sheets for the lourvered corrugated fins to be interposed between adjacent flat refrigerant tubes. Stated more specifically, if the brazing sheet is used for the louvered corrugated fins, there arises the problem that the cutter will wear when making the fins since the brazing layer of the brazing sheet is harder than the core layer thereof, whereas this program can be overcome.

Preferably, the height of the tube is in the range of 0.8 to 3.5 mm, more preferably in the range of 1.4 to 2.3 mm. If the tube height is less than 0.8 mm, the refrigerant passages are lower to result in a pressure loss of the refrigerant, whereas if it is more than 3.5 mm, not only difficulty, is encountered in fabricating a compacted heat exchanger but the tube also offers increased resistance to the passage of air to entail a lower heat exchange efficiency.

The pitch of reinforcing walls in the width-wise direction of the tube is preferably in the range of 0.5 to 5.0 mm, more preferably in the range of 1.0 to 2.5 mm. When the wall pitch is less than 0.5 mm, the refrigerant passages become narrower to produce a refrigerant pressure loss, whereas if it exceeds 5.0 mm, an impaired heat exchange efficiency will result.

For the same reason as is the case with the tube height, the height of reinforcing walls is preferably in the range of 0.5 to 2.5 mm, more preferably in the range of 0.8 to 1.5 mm.

The cross sectional area of communication holes is preferably in the range of 0.07 to 5.0 $mm^2$, more preferably in the range of 0.2 to 1.25 $mm^2$. When the cross sectional area of the holes is less than 0.07 $mm^2$, the refrigerant will not flow through the holes satisfactorily, while the brazing agent, i.e., filler metal, melted for brazing is likely to close the hole. If the area is in excess of 5.0 $mm^2$, the refrigerant tube will be reduced in pressure resistance.

The pitch of communication holes is preferably in the range of 4.0 to 100 mm, more preferably in the range of 10 to 50 mm. If the hole pitch is less than 4.0 mm, the refrigerant tube exhibits lower pressure resistance, whereas if it is over 100 mm, the refrigerant fails to satisfactorily flow through the holes.

The present invention will be described in greater detail with reference to the accompanying drawings.

DESCRIPTION OF THE PREFERRED EMBODIMENTS

Figure 16:
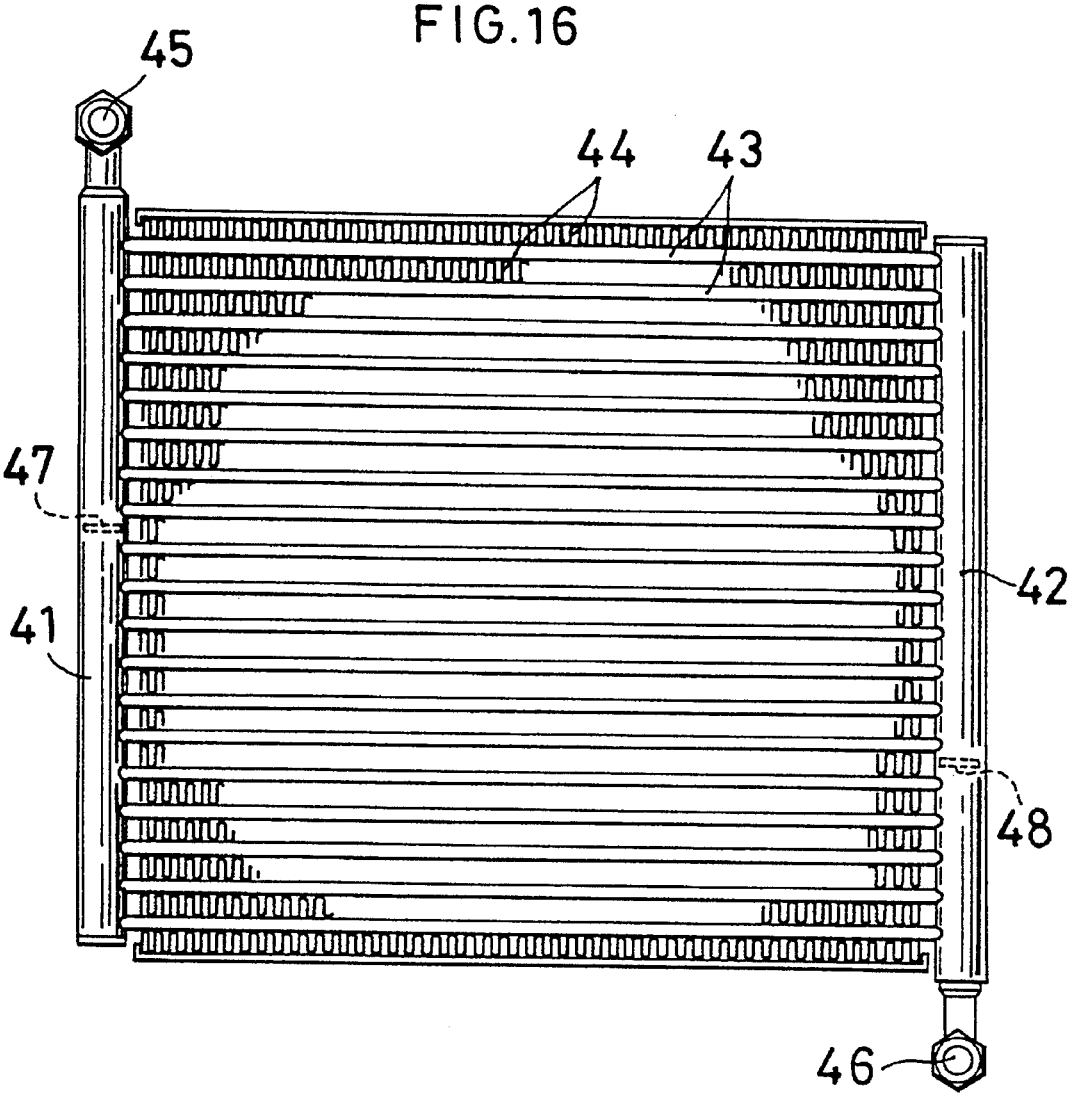
FIG. 16 is a plan view showing a condenser comprising flat refrigerant tubes.

FIG. 16 shows a condenser comprising flat refrigerant tubes embodying the invention. The condenser comprises a pair of headers 41, 42 arranged at right and left in parallel and spaced apart from each other, parallel flat refrigerant tubes 43 each joined at its opposite ends to the two headers 41, 42, corrugated fins 44 arranged in an air flow clearance between adjacent refrigerant tubes 43 and brazed to the adjacent refrigerant tubes 43, an inlet pipe 45 connected to the upper end of the left header 41, an outlet pipe 46 connected to the lower end of the right header 42, a left partition 47 provided inside the left header 41 and positioned above the midportion thereof, and a right partition 48 provided inside the right header 42 and positioned below the midportion thereof, the number of refrigerant tubes 43 between the inlet pipe 45 and the left partition 47, the number of refrigerant tubes 43 between the left partition 47 and the right partition 48 and the number of refrigerant tubes 43 between the right partition 48 and the outlet pipe 46 decreasing from above downward. A refrigerant flowing into the inlet pipe 45 in a gas phase flows zigzag through the condenser before flowing out from the outlet pipe 46 in a liquid phase.

The refrigerant tubes 43 in the above condenser are concerned with the present invention. Embodiments of the invention will be described below with reference to the accompanying drawings.

EMBODIMENT 1

Figure 5:
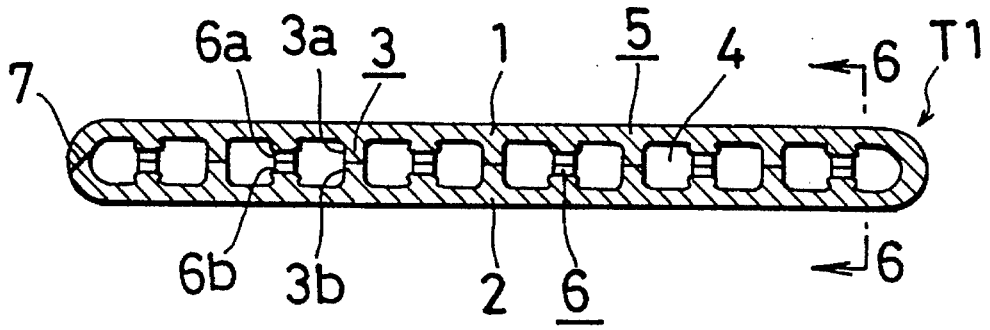
FIG. 5 is a cross sectional view of the flat refrigerant tube of Embodiment 1 of the invention.
Figure 6:
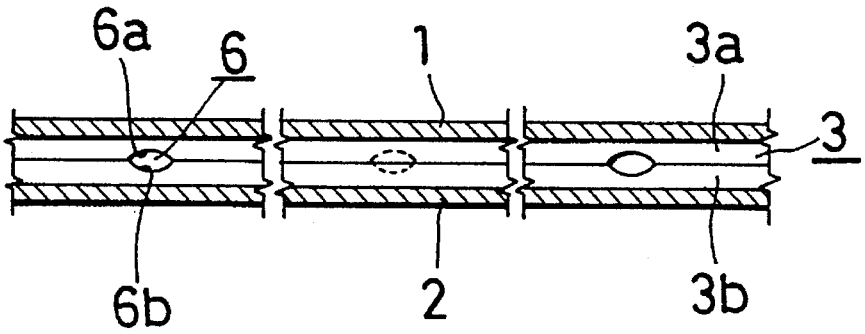
FIG. 6 is a view in section taken along the line 6—6 in FIG. 5.

This embodiment is shown in FIGS. 5 and 6. A refrigerant tube T1 for heat exchangers is formed by a flat aluminum tube 5 having parallel refrigerant passages 4 in its interior and comprising flat upper and lower walls 1, 2 and a plurality of reinforcing walls 3 connected between the upper and lower walls 1, 2, extending longitudinally of the tube and spaced apart from one enother by a predetermined distance. The reinforcing walls 3 are each formed with a plurality of communication holes 6 for causing the parallel refrigerant passages 4 to communicate with one enother.

The flat aluminum tube 5 is prepared from an aluminum sheet in the form of a brazing sheet having a filler metal layer on each side thereof, by folding the sheet at the midportion of its width like a hairpin so as to form a hollow portion, bending opposite side edges to an arcuate form and joining the side edges together in butting contact with each other.

The butt joint 7 thus formed is oblique in cross section so as to give an increased area of joint.

Each of the reinforcing walls 3 is formed by joining a downward ridge 3*a* inwardly projecting from the upper wall 1 and formed by rolling to an upward ridge 3*b* inwardly projecting from the lower wall 2 and formed by rolling. Each of the communication holes 6 is formed by the combination of a pair of cutouts 6*a*, 6*b*. Such cutouts 6*a*, 6*b* are formed respectively in the lower edge of the downward ridge 3*a* and the upper edge of the upward ridge 3*b* at a predetermined spacing.

The communication holes 6 formed in the plurality of reinforcing walls 3 are in a staggered arrangement when seen from above.

The flat aluminum tube 5 is 1.70 mm in height, 1.45 mm in the pitch of reinforcing walls 3, 1.0 mm in the height of reinforcing walls 3, 0.40 mm in the thickness of reinforcing walls 3, 0.6 mm in the cross sectional area of communication holes 6, 40 mm in the pitch of holes 6, 18 mm in width and 0.35 mm in the thickness of upper and lower walls 1, 2.

The refrigerant tube T1 is produced by the following method.

Figure 1:
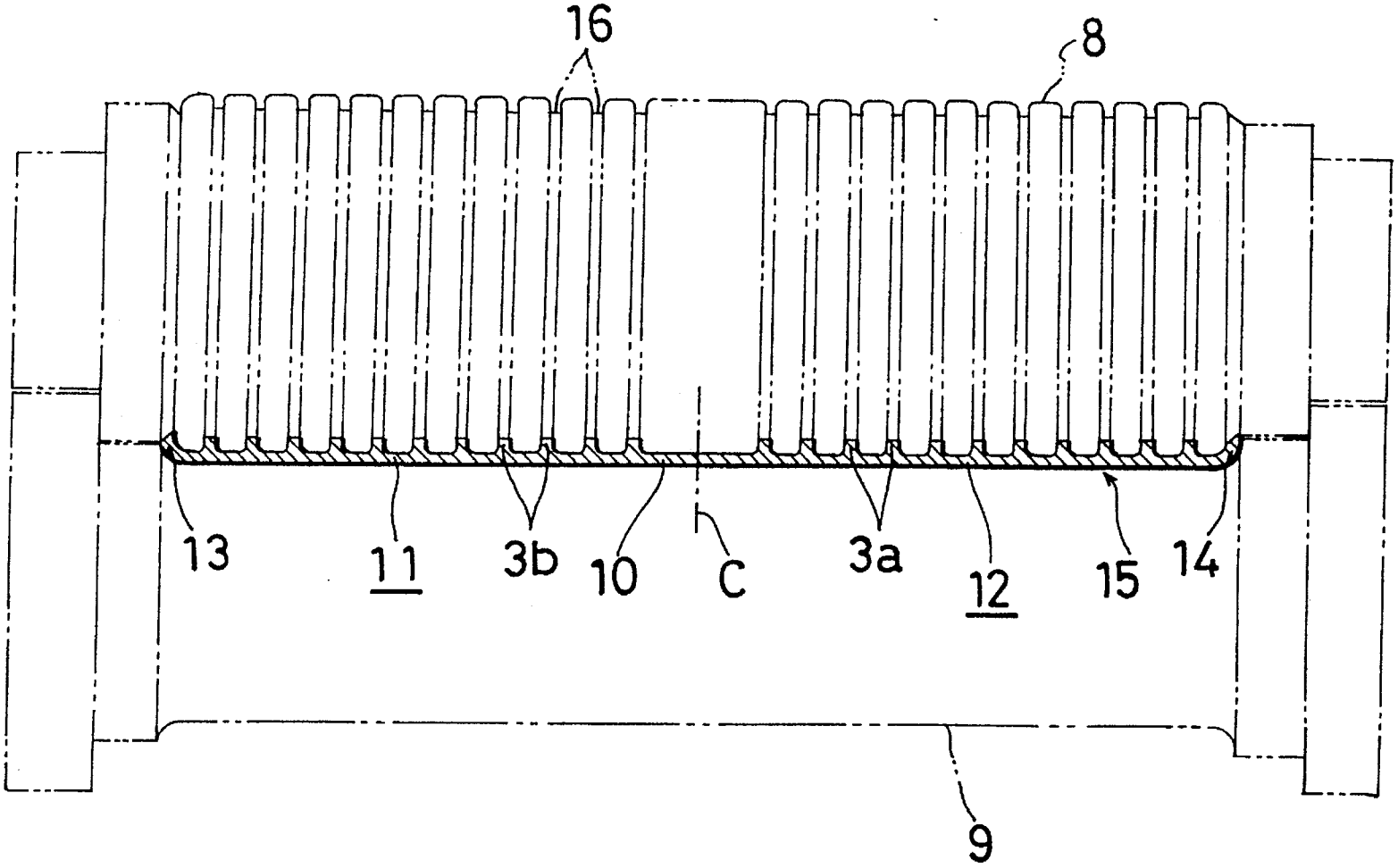
FIG. 1 is a cross sectional view showing how to produce a flat refrigerant tube as Embodiment 1 of the invention by rolling an aluminum sheet.

With reference to FIG. 1, the tube T1 is prepared from an aluminum sheet blank in the form of a brazing sheet having a thickness greater than the wall thickness of the tube to be produced, i.e., 0.8 mm, by rolling the blank with a pair of upper and lower rolls 8, 9, the upper roll 8 having parallel annular grooves 16 symmetrically on opposite sides of the middle C of its length. The rolling operation reduces the thickness of the blank to the specified tube wall thickness with the peripheral surfaces of the rolls 8, 9 to form a flat portion forms ridges 3*a*, 3*b* as projected from the flat portion with the annular grooves 16 and also bends opposite sides edges toward the direction of projection of the ridges, whereby a rolled aluminum sheet 15 is obtained. The sheet 15 has a flat portion 10 in the middle of its width, portions 11, 12 provided on opposite sides of the flat portion 10 and resembling comb teeth in cross section, and arcuate raised portions 13, 14 at the respective side edges.

Figure 2:
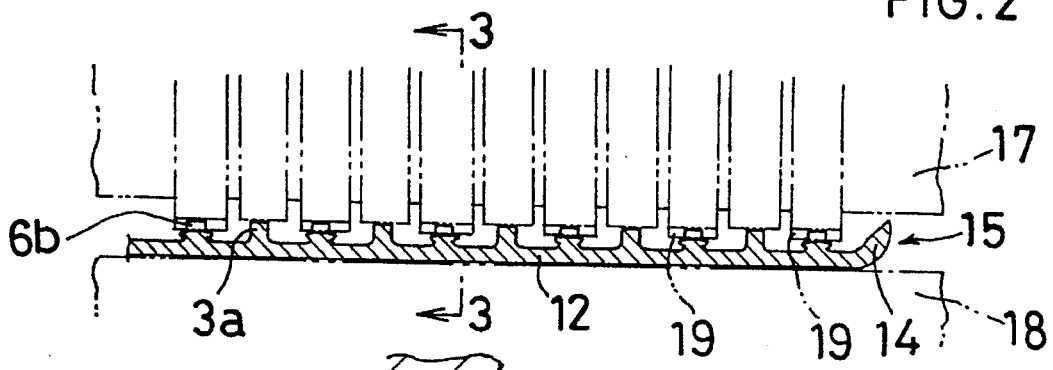
FIG. 2 is a cross sectional view showing how to form cutouts in the upper edges of ridges of a portion of the aluminum sheet shown in FIG. 1 which portion resembles comb teeth in cross section.
Figure 3:
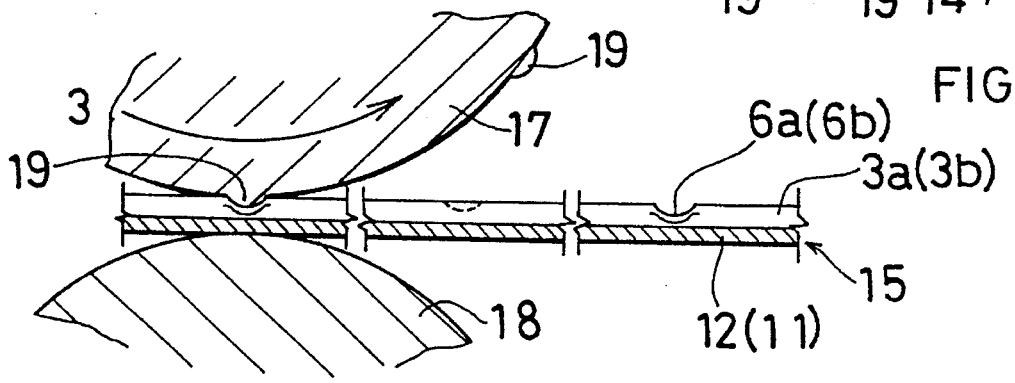
FIG. 3 is a view in section taken along the line 3—3 in FIG. 2.

As shown in FIGS. 2 and 3, the rolled aluminum sheet 15 is passed between a pair of upper and lower rolls 17, 18, the upper roll 17 having protrusions 19 approximately semicircular in cross section and arranged at a predetermined spacing at the position coinciding with each of the parallel annular grooves 16 in the upper roll 8 used in the preceding step. This rolling operation forms approximately semicircular cutouts 6*a*, 6*b* in the upper edges of the respective ridges 3*a*, 3*b* at the predetermined spacing.

Figure 4:
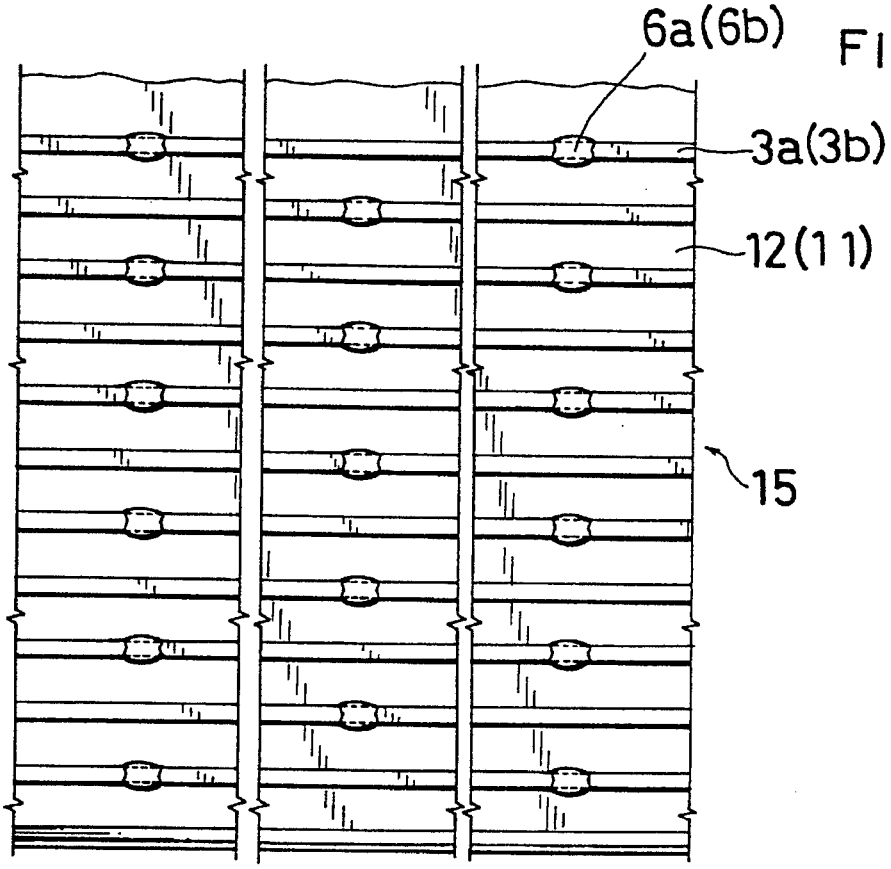
FIG. 4 is a view of the aluminum sheet of FIG. 2.

As seen in FIG. 4, the protrusions 19, which are provided in a large number, are in a staggered arrangement so that the cutouts 6*a*, 6*b* are formed in the parallel ridges 3*a*, 3*b* in a staggered arrangement when seen from above. Each of the protrusion 19 is formed therearound with a recess which is V-shaped in cross section so that the cutout 6*a* or 6*b* is surrounded by a peripheral edge projecting inward and having an inverted V-shaped cross section. The recess, which is V-shaped, may alternatively be arcuate in cross section.

Finally, the aluminum sheet 15 having the cutouts 6*a*, 6*b* in the respective ridges 3*a*, 3*b* is folded at the middle of its width like a hairpin, and the side edges are butted against and joined to each other, whereby a flat aluminum tube 5 is formed as shown in FIG. 5. With this tube 5, the downward ridges 3*a* are joined to the respective upward ridges 3*b* to form reinforcing walls 3, with the cutouts 6*a* in the ridges 3*a* combined with the corresponding cutouts 6*b* in the ridges 3*b* to form elliptical communication holes 6 for causing the parallel refrigerant passages 4 to communicate with one another therethrough. The portions concerned are joined together by brazing. Since the communication hole 6 is surrounded by inwardly projecting peripheral edge which is inverted V-shaped in cross section and spreads from inside outward at opposite sides, the refrigerant smoothly flows therethrough into or out of the refrigerant passage 4 on either side thereof.

Figure 7:
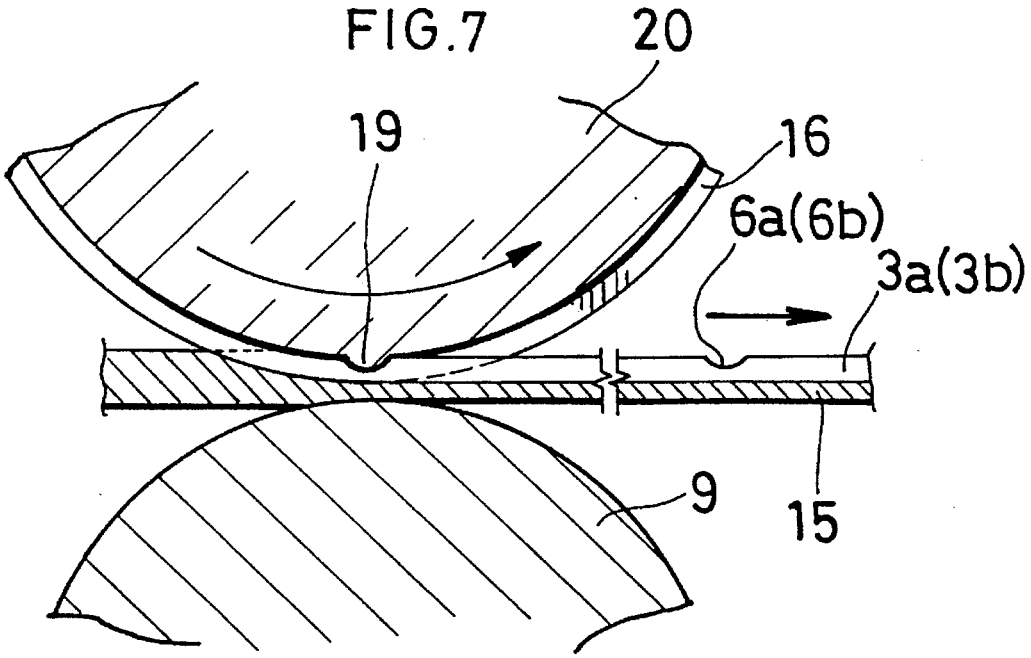
FIG. 7 is a view in longitudinal section showing how to form ridges and cutouts by a single step.

With the above embodiment, the ridges 3*a*, 3*b* having the cutouts 6*a*, 6*b* are formed by two steps, whereas these ridges 3*a*, 3*b* with the cutouts 6*a*, 6*b* can be formed by a single step by using in combination with the lower roll 9 of the first step an upper roll 20 which is formed in each of parallel annular grooves 16 with protrusions 19 arranged at a predetermined spacing and having a height smaller than the depth of the groove as shown in FIG. 7.

The upper rolling roll peripheral surface may be formed with indentations and projections which are triangular wave-like in cross section, or knurled (not shown). The aluminum tube 5 obtained then has projections and indentations extending longitudinally thereof over the inner surface or an inner surface having latticelike projections or indentations. This gives an increased surface area to the walls defining the refrigerant passages.

EMBODIMENT 2

Figure 9:
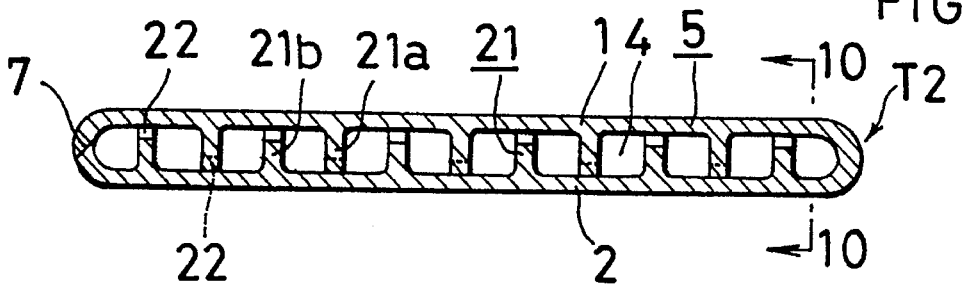
FIG. 9 is a cross sectional view of the flat refrigerant tube of Embodiment 2 of the invention.
Figure 10:
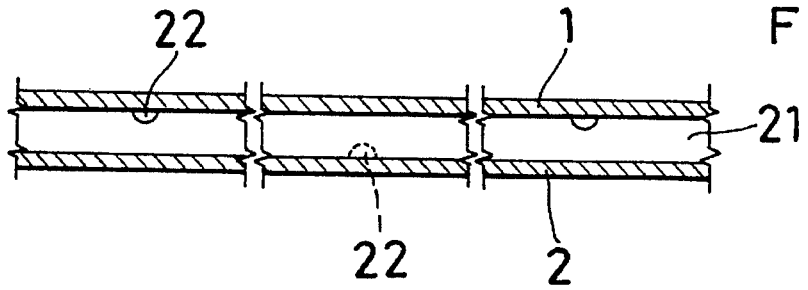
FIG. 10 is view in section taken along the line 10—10 in FIG. 9.

This embodiment is shown in FIGS. 9 and 10. A refrigerant tube T2 for use in heat exchangers has two kinds of reinforcing walls 21. The walls 21 of one kind are each formed by a downward ridge 21*a* inwardly projecting from an upper wall 1 and joined to a flat inner surface portion of a lower wall 2. The walls 21 of the other kind are each formed by an upward ridge 21*b* inwardly projecting from the lower wall 2 and joined to a flat inner surface portion of the upper wall 1. The two kinds of walls 21 are arranged alternately. Communication holes 22 are formed by cutouts provided in the lower edge of the downward ridge 21*a* and in the upper edge of the upward ridge 21*b* and have their open portions closed by one of the upper and lower walls 1, 2. With the exception of this feature, the present embodiment is the same as Embodiment 1.

The refrigerant tube T2 is produced by the following method.

Figure 8:
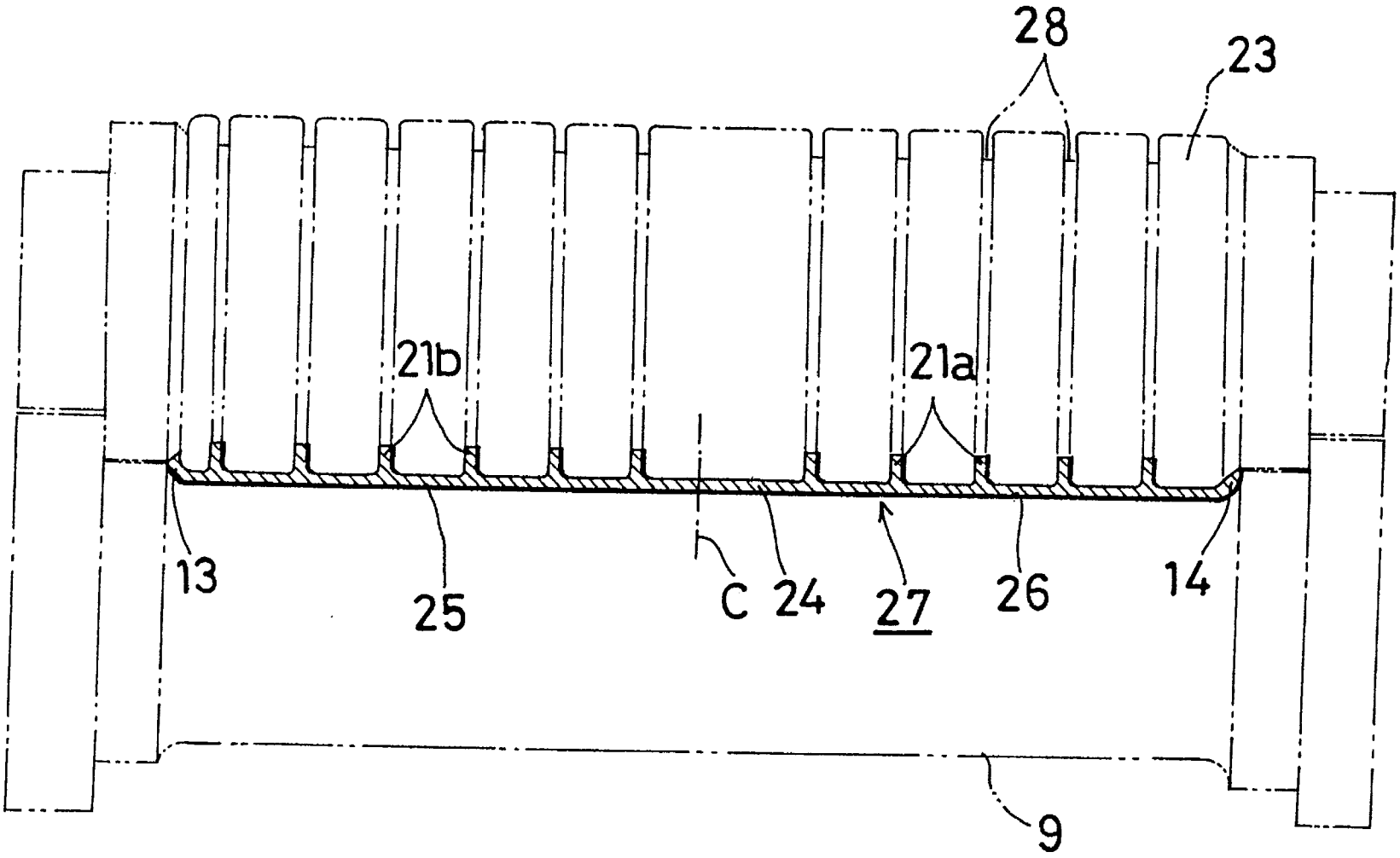
FIG. 8 is a cross sectional view showing how to produce a flat refrigerant tube as Embodiment 2 of the invention by rolling an aluminum sheet.

As shown in FIG. 8, the tube T2 is prepared from the same aluminum sheet blank as used for Embodiment 1 by rolling the blank with a pair of upper and lower rolls 23, 9, the upper roll 23 having parallel annular grooves 28 on opposite sides of the middle C of its length. The rolling operation reduces the thickness of the blank to the specified tube wall thickness with the peripheral surfaces of the rolls 23, 9 to form a flat portion, forms ridges 21*a*, 21*b* as projected from the flat portion integrally therewith with the annular grooves 28 and also bends opposite side edges toward the direction of projection of the ridges, whereby a rolled aluminum sheet 27 is obtained. The sheet 27 has a flat portion 24 in the middle of its width, portions 25, 26 provided respectively on the left and right sides of the flat portion 24 and resembling comb teeth in cross section, and arcuate raised portions 13, 14 at the respective side edges. The ridges 21*b* of the left comblike portion 25 are provided in an even number, while the ridges 21*a* of the right comblike portion 26 are provided in an odd number smaller than the even number by one.

Next, cutouts are formed in the ridges 21*a*, 21*b* in the same manner as in making Embodiment 1.

Finally, the aluminum sheet 27 having the cutouts in the ridges 21*a*, 21*b* is folded at the middle of its width like a hairpin, and the side edges are butted against and joined to each other, whereby a flat aluminum tube 5 is formed as shown in FIG. 9. The ridges 21*a* of the upper wall 1 are joined to flat portions of the lower wall 2, and the ridges 21*b* of the lower wall 2 to flat portions of the upper wall 1 alternately to form reinforcing walls 21. The open portions of the cutouts in the ridges 21*a*, 21*b* are closed with flat wall portions to form communication holes 22 for causing parallel refrigerant passages 4 to communicate with one another.

EMBODIMENT 3

Figure 12:
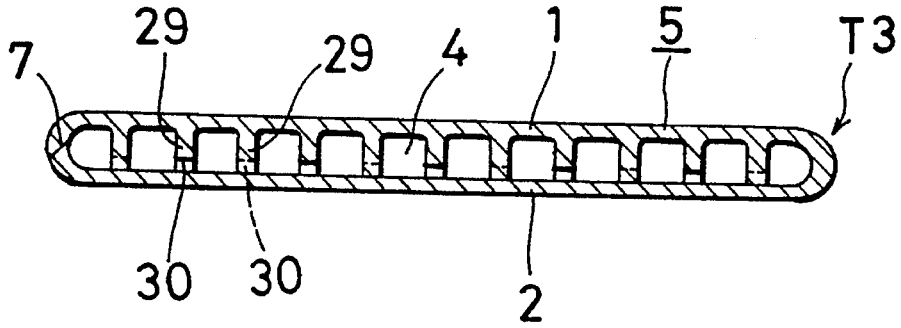
FIG. 12 is a cross sectional view of the flat refrigerant tube of Embodiment 3 of the invention.

FIG. 12 shows this embodiment, i.e., a refrigerant tube T3 for use in heat exchangers. The tube has reinforcing walls 29 which are formed by ridges 29*a* inwardly projecting from an upper wall 1 and joined to a flat inner surface of a lower wall 2. Communication holes 30 are formed by providing cutout portions in the edges of the ridges 29*a* at a predetermined spacing and closing the openings of the cutouts with the lower wall 2. Except for this feature, the present embodiment is the same as Embodiment 1.

The refrigerant tube T3 is produced by the following method.

Figure 11:
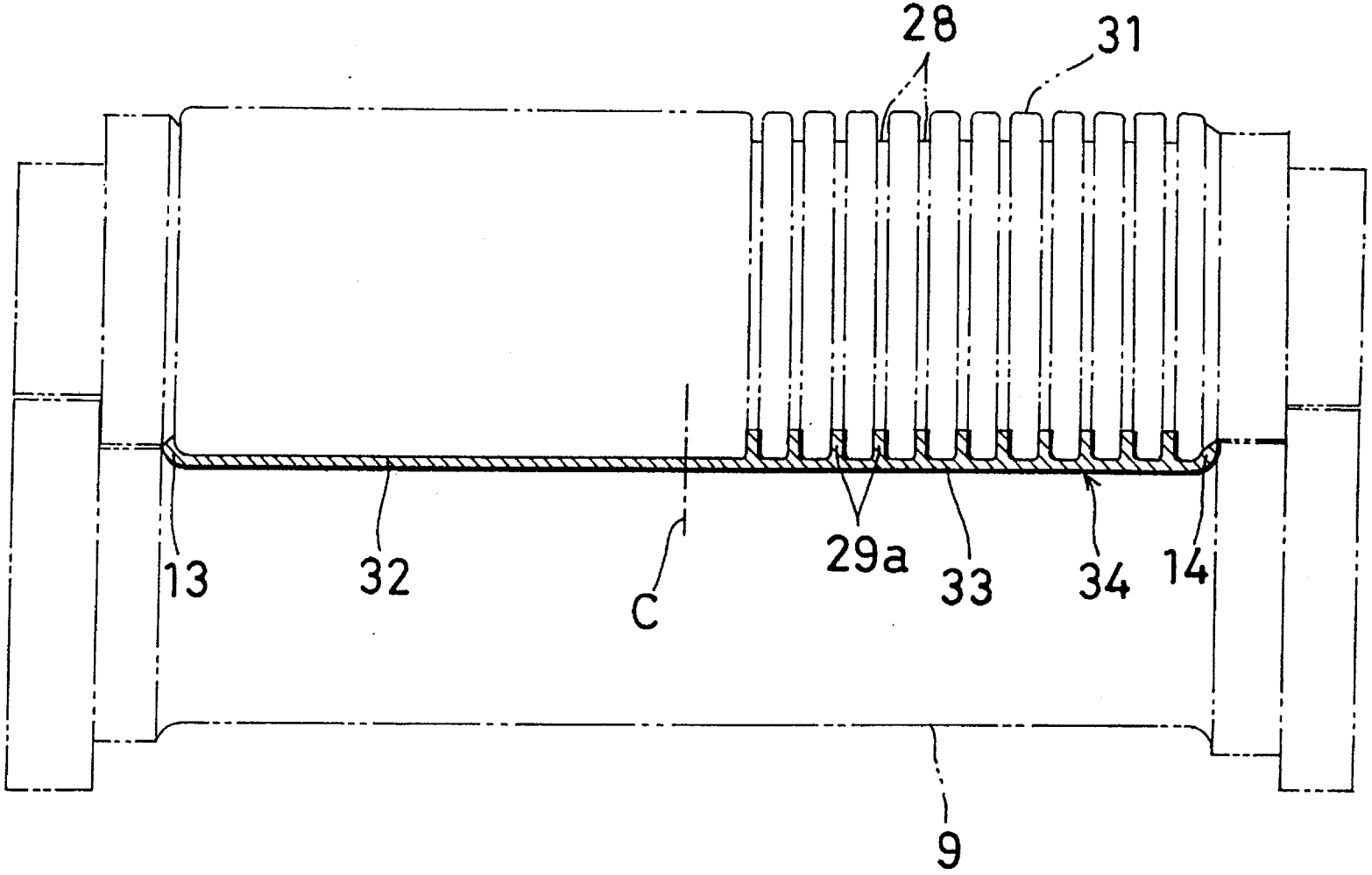
FIG. 11 is a cross sectional view showing how to produce a flat refrigerant tube as Embodiment 3 of the invention by rolling aluminum sheet.

As shown in FIG. 11, the tube T3 is prepared from the same aluminum sheet blank as used for Embodiment 1 by rolling the blank with a pair of upper and lower rolls 31, 9, the upper roll 31 having parallel annular grooves 28 symmetrically on opposite sides of the middle C of its length. The rolling operation reduces the thickness of the blank to the specified tube wall thickness with the peripheral surfaces of the rolls 31, 9 to form a flat portion, forms ridges 29*a* as projected from the flat portion integrally therewith with the annular grooves 28 and also bends opposite side edges toward the direction of projection of the ridges, whereby a rolled aluminum sheet 34 is obtained. The sheet 34 has a flat portion 32 on the left side of the middle of its width, a portion 33 provided on the left side thereof and resembling comb teeth in cross section, and arcuate raised portions 13, 14 at the respective side edges.

Next, cutouts are formed in the upper edges of the ridges 29*a* in the same manner as in Embodiment 1.

Finally, the aluminum sheet 34 having the cutouts in the ridges 29*a* is folded at the middle of its width like a hairpin, and the side edges are butted against and joined to each other, whereby a flat aluminum tube 5 is formed. The ridges 29*a* on one of the upper and lower walls 1, 2 are joined to the flat portion of the other wall to form reinforcing walls 29, and the openings of the cutouts in the ridges 29*a* are closed with the flat portion to form communication holes 30 for causing parallel refrigerant passages 4 to communciate with one another therethrough.

EMBODIMENT 4

Figure 13:
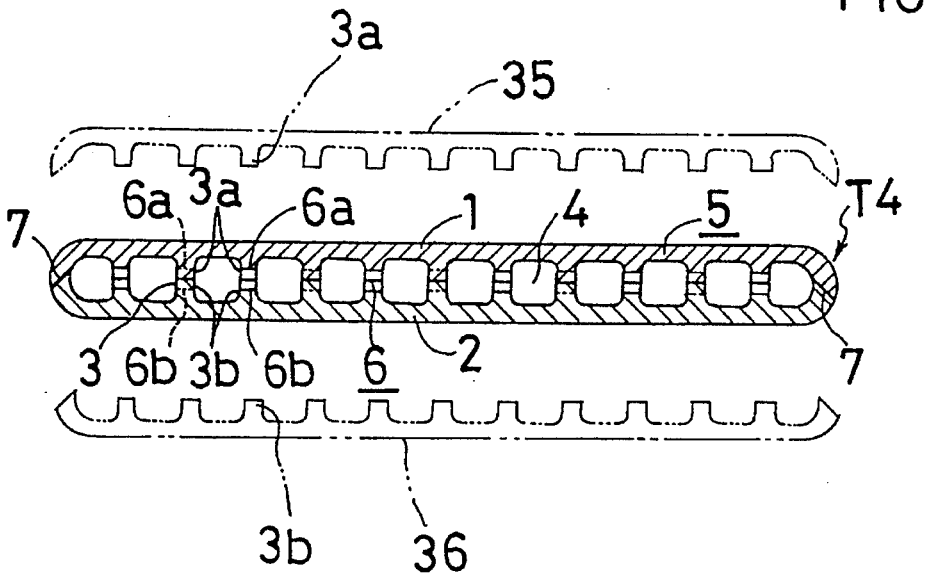
FIG. 13 its a cross sectional view of another flat refrigerant tube, i.e., Embodiment 4 of the invention.

FIG. 13 shows this embodiment, i.e., a refrigerant tube T4 for use in heat exchangers. The tube is formed by a flat aluminum tube 5. The tube 5 is formed from two upper and lower aluminum sheets 35, 36 by bending opposite side edges of the sheets to an arcuate form toward each other so as to form a hollow portion, butting the sheets against each other edge to edge and joining the butted edges together. Except for this feature, the present embodiment is the same as Embodiment 1.

The refrigerant tube T4 is produced by the following method.

As indicated in broken lines in FIG. 13, two aluminum sheets 35, 36 are prepared in the same manner as is the case with Embodiment 1. Each of the sheets 35, 36 has arcuate portions at its opposite side edges, a comblike portion positioned between the arcuate portions and having ridges 3*a* (3*b*) resembling comb teeth in cross section, and cutouts 6*a* (6*b*) formed in the ridge 3*a* (3*b*). The two sheets are joined together by brazing with the ridges 3*a*, 3*b* facing inward, whereby the refrigerant tube T4 is obtained.

EMBODIMENT 5

Figure 14:
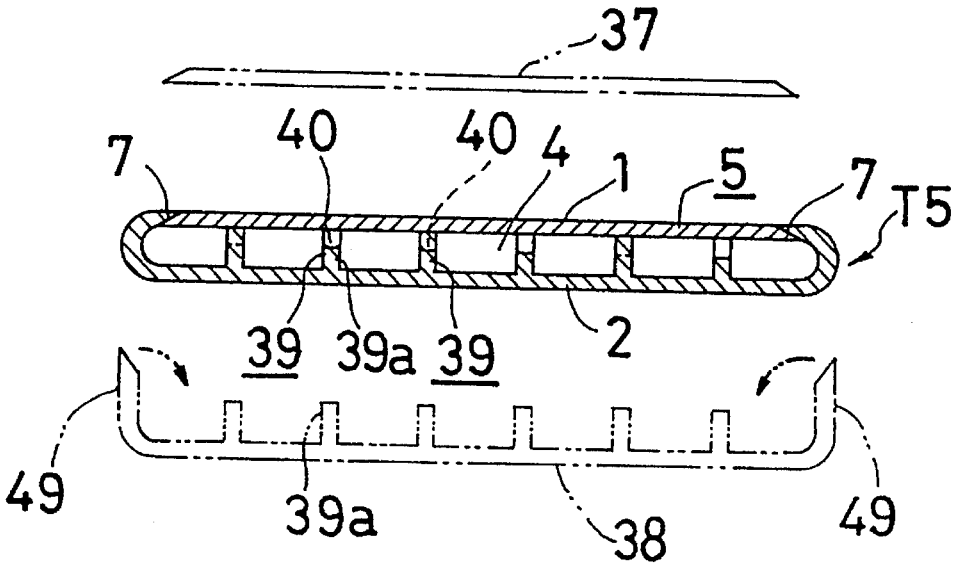
FIG. 14 is a cross sectional view of another flat refrigerant tub i.e., Embodiment 5 of the invention.

FIG. 14 shows this embodiment, i.e., a refrigerant tube T5 for use in heat exchangers. The tube T5 is formed by a flat aluminum tube 5 having parallel refrigerant passages 4 in its interior and comprising flat upper and lower walls 1, 2 and a plurality of reinforcing walls 39 connected between the upper and lower walls 1, 2, extending longitudinally of the tube and spaced apart from one another by a predetermined distance. The reinforcing walls 39 are each formed with a plurality of communication holes 40 for causing the parallel refrigerant passages 4 to communicate with one another therethrough.

The flat aluminum tube 5 is prepared from upper and lower two aluminum sheets 37, 38 each in the form of a brazing sheet having a filler metal layer on each side, by bending the lower sheet 38 at its opposite side edges to an arcuate form, butting the bent edges against the respective edges of the upper sheet and joining the two sheets together at the butted edges so as to form a hollow portion therebetween.

The reinforcing walls 39 are formed by ridges 39*a* projecting inward from the lower wall 2 and joined to a flat inner surface of the upper wall 1. The communication holes 40 are formed by cutouts provided in the edge of each ridge 39*a* at a predetermined spacing and having its openings closed by the upper wall 1.

The flat aluminum tube 5 is 1.70 mm in height, 2.45 mm in the pitch of reinforcing walls 3, 1.0 mm in the height of reinforcing walls 3, 0.40 mm in the thickness of reinforcing walls 3, 0.6 $mm^2$ in the cross sectional area of communication holes 6, 40 mm in the pitch of holes 6, 18 mm in width and 0.35 mm in the thickness of the upper and lower walls 1, 2.

With the exception of the above features, the present embodiment is the same as Embodiment 1.

The refrigerant tube T5 is produced by the following method.

First, an aluminum sheet blank in the form of a brazing sheet having a thickness greater than the wall thickness of the refrigerant tube to be produced, i.e., a thickness of 1.2 mm, is rolled by a pair of upper and lower rollers, the upper roll having parallel annular grooves to reduce the thickness of the blank to the specified tube wall thickness with the peripheral surfaces of the rolling rolls and thereby form a flat lower wall 2. At the ssame time, the rolling operation forms with the annular grooves ridges projecting from the flat portion integrally therewith, and also raised portions 49 at the respective side edges of the blank as indicated in broken lines in FIG. 14, the portions 49 being higher than the ridges.

Next, cutouts are formed in the upper edges of the ridges in the same manner as in Embodiment 1.

Finally, another flat aluminum sheet 37 having the same thickness as the lower wall 2 is placed over all the ridges 39*a* for use as an upper wall 1, the raised portions 49 are bent inward and the edges thereof are joined to the respective side edges of the upper wall 1, whereby a flat aluminum tube 5 is formed. At the same time, the ridges 39*a* of the lower wall 2 are joined to the upper wall 1 to form reinforcing walls 39, with the openings of the cutouts in the ridges 39*a* closed with the upper wall 1 to form communication holes 40 for causing parallel refrigerant passages 4 to communicate with one another therethrough.

EMBODIMENT 6

Figure 15:
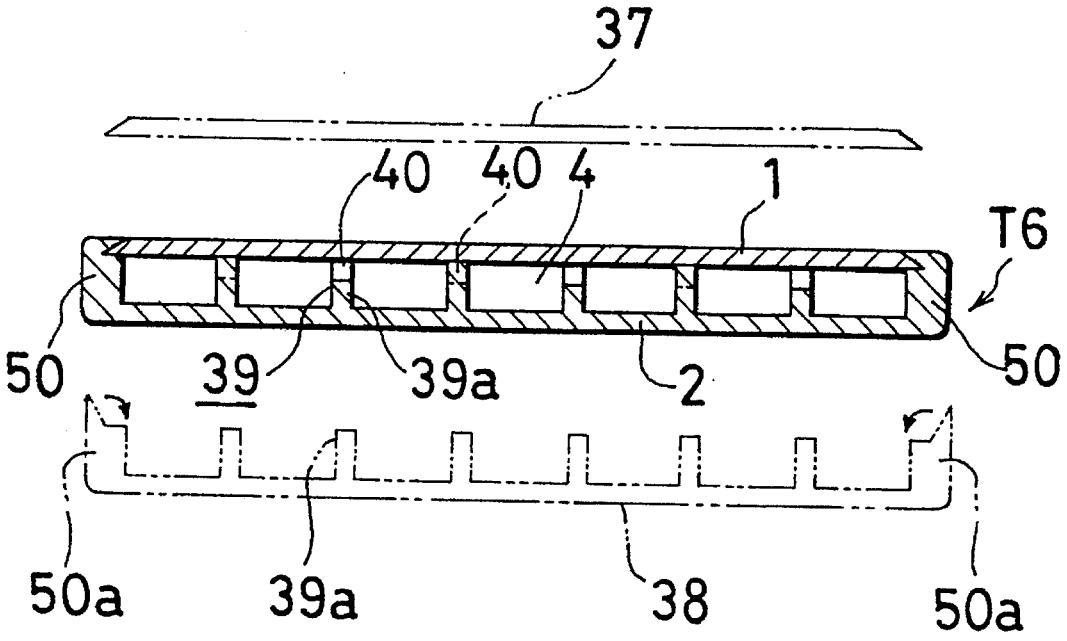
FIG. 15 is a cross sectional view of another flat refrigerant tube i.e., Embodiment 6 of the invention.

FIG. 15 shows this embodiment, i.e., a refrigerant tube T6 for use in heat exchangers. This embodiment is the same as Embodiment 5 except that the embodiment has vertical side walls 50 which have a larger thickness than the upper and lower walls 1, 2.

The refrigerant tube T6 is produced by the same method as Embodiment 5 except the following. With this embodiment, raised portions 50*a* are formed at opposite side edges of a lower aluminum sheet 38 with a larger thickness than the other portion. Each raised portion 50*a* has an upper part including a step 51 at the same level as the upper edges of the ridges 39*a*, and a projection 53 integral with the step and having a slanting face 52 extending outwardly upward from the step, the step 51 and the projection 53 extending longitudinally of the sheet 38. A flat upper wall 1 is placed at its opposite side edges on the respective steps 51, the projections 53 are crimped inward, and the slanting faces 52 are placed over and joined to slanting faces at the respective side edges of the upper wall 1.

What is claimed is:

1. A method of producing a refrigerant tube for use in heat exchangers comprising a flat aluminum tube having parallel refrigerant passages in its interior and comprising flat upper and lower walls and a plurality of reinforcing walls connected between the upper and lower walls, the reinforcing walls extending longitudinally of the tube and being spaced apart from one another by a predetermined distance, the method comprising the step of rolling an aluminum sheet blank having a thickness greater than the wall thickness of the refrigerant tube to be produced with a pair of upper and lower rolling rolls one of which has parallel annular grooves symmetrically on opposite sides of the middle of its length and thereby reducing the thickness of the blank to the specified tube wall thickness with the peripheral surfaces of the rolling rolls to form a flat portion and to cause the annular grooves to form ridges projecting from the flat portion integrally therewith and bend at least one of opposite side edges of the blank in the direction of projection of the ridges, the step of passing the rolled aluminum sheet between a pair of upper and lower rolls one of which has protrusions approximately semicircular in cross section and arranged at a predetermined spacing at a position corresponding to each of the parallel annular grooves in the rolling roll used in the preceding step to form in upper edges of the ridges approximately semicircular cutouts at the predetermined spacing, and the step of folding the aluminum sheet having the cutouts in the ridges at the middle of its width like a hairpin and joining opposite side edges of the sheet together in butting contact with each other to thereby form the flat aluminum tube, joining upward ridges to downward ridges to form the reinforcing walls and combining the cutouts of the upward and downward ridges to form communication holes for causing the parallel refrigerant passages to communicate with one another therethrough.

2. A method of producing a refrigerant tube for use in heat exchangers comprising a flat aluminum tube having parallel refrigerant passages in its interior and comprising flat upper and lower walls and a plurality of reinforcing walls connected between the upper and lower walls, the reinforcing walls extending longitudinally of the tube and being spaced apart from one another by a predetermined distance, the method comprising the step of rolling an aluminum sheet blank having a thickness greater than the wall thickness of the refrigerant tube to be produced with a pair of upper and lower rolling rolls one of which has parallel annular grooves on opposite sides of the middle of its length, the annular grooves on one of the opposite sides being displaced from the annular grooves on the other side by one-half toward one side edge, and thereby reducing the thickness of the blank to the specified tube wall thickness with the peripheral surfaces of the rolling rolls to form a flat portion and to cause the annular grooves to form ridges projecting from the flat portion integrally therewith and bend at least one of opposite side edges of the blank in the direction of projection of the ridges, the step of passing the rolled aluminum sheet between a pair of upper and lower rolls one of which has protrusions approximately semicircular in cross section and arranged at a predetermined spacing at a position corresponding to each of the parallel annular grooves in the rolling roll used in the preceding step to form in upper edges of the ridges approximately semicircular cutouts at the predetermined spacing, and the step of folding the aluminum sheet having the cutouts in the ridges at the middle of its width like a hairpin and joining opposite side edges of the sheet together in butting contact with each other to thereby form the flat aluminum tube, joining the ridges of the upper wall to the flat portion of the lower wall and the ridges of the lower wall to the flat portion of the upper wall alternately to form the reinforcing walls and closing openings of the cutouts in the ridges with the flat portion to form communication holes for causing the parallel refrigerant passages to communicate with one another therethrough.

3. A method of producing a refrigerant tube for use in heat exchangers comprising a flat aluminum tube having parallel refrigerant passages in its interior and comprising flat upper and lower walls and a plurality of reinforcing walls connected between the upper and lower walls, the reinforcing walls extending longitudinally of the tube and being spaced apart from one another by a predetermined distance, the method comprising the step of rolling an aluminum sheet blank having a thickness greater than the wall thickness of the refrigerant tube to be produced with a pair of upper and lower rolling rolls one of which has parallel annular grooves on one of opposite sides of the middle of its length and thereby reducing the thickness of the blank to the specified tube wall thickness with the peripheral surfaces of the rolling rolls to form a flat portion and to cause the annular grooves to form ridges projecting from the flat portion integrally therewith and bend at least one of opposite side edges of the blank in the direction of projection of the ridges, the step of passing the rolled aluminum sheet between a pair of upper and lower rolls one of which has protrusions approximately semicircular in cross section and arranged at a predetermined spacing at a position corresponding to each of the parallel annular grooves in the rolling roll used in the preceding step to form in upper edges of the ridges approximately semicircular cutouts at the predetermined spacing, and the step of folding the aluminum sheet having the cutouts in the ridges at the middle of its width like a hairpin and joining opposite side edges of the sheet together in butting contact with each other to thereby form the flat aluminum tube, joining the ridges of one of the upper and lower walls to the flat portion of the other wall to form the reinforcing walls and closing openings of the cutouts in the ridges with the flat portion to form communication holes for causing the parallel refrigerant passages to communicate with one another therethrough.

4. A method of producing a refrigerant tube for use in heat exchangers comprising a flat aluminum tube having parallel refrigerant passages in its interior and comprising flat upper and lower walls and a plurality of reinforcing walls connected between the upper and lower walls, the reinforcing walls extending longitudinally of the tube and being spaced apart from one another by a predetermined distance, the method comprising the step of rolling an aluminum sheet blank having a thickness greater than the wall thickness of the refrigerant tube to be produced with a pair of upper and lower rolling rolls one of which has parallel annular grooves and thereby reducing the thickness of the blank to the specified tube wall thickness with the peripheral surfaces of the rolling rolls to form the flat lower wall and to cause the annular grooves to form ridges projecting from the lower wall integrally therewith and form at each of opposite side edges of the lower wall a raised portion higher than the ridges, the step of passing the rolled aluminum sheet between a pair of upper and lower rolls one of which has protrusions approximately semicircular in cross section and arranged at a predetermined spacing at a position corresponding to each of the parallel annular grooves in the rolling roll used in the preceding step to form in upper edges of the ridges approximately semicircular cutouts at the predetermined spacing, and the step of placing another flat aluminum sheet having the same thickness as the lower wall over all the ridges to provide the upper wall and joining opposite sides edges of the upper wall to edges of the raised portions to thereby form the flat aluminum tube, joining the ridges of the lower wall to the upper wall to form the reinforcing walls and closing openings of the cutouts in the ridges with the upper wall to form communication holes for causing the parallel refrigerant passages to communicate with one another therethrough.

5. A method of producing a refrigerant tube for use in heat exchangers comprising a flat aluminum tube having parallel refrigerant passages in its interior and comprising flat upper and lower walls and a plurality of reinforcing walls connected between the upper and lower walls, the reinforcing walls extending longitudinally of the tube and being spaced apart from one another by a predetermined distance, the method comprising rolling an aluminum sheet blank having a thickness greater than the wall thickness of the refrigerant tube to be produced with a pair of upper and lower rolling rolls one of which has parallel annular grooves and thereby reducing the thickness of the blank to the specified tube wall thickness with the peripheral surfaces of the rolling rolls to form a flat portion serving as at least one of the upper wall and the lower wall and form vertical ridges projecting from the flat portion integrally therewith and providing the reinforcing walls with the annular grooves.

6. A method as defined in claim 5 wherein the rolled aluminum sheet is further passed between a pair of upper and lower rolls one of which has protrusions approximately semicircular in cross section and arranged at a predetermined spacing at a position corresponding to each of the parallel annular grooves in the rolling roll to form in upper edges of the ridges approximately semicircular cutouts arranged at the predetermined spacing and providing communication holes for causing the parallel refrigerant passages to communicate with one another therethrough.

7. A method as defined in claim 5 wherein when the ridges projecting from the flat portion integrally therewith and providing the reinforcing walls are formed, a roll formed in each of parallel annular grooves therein with protrusions arranged at a predetermined spacing and having a height smaller than the depth of the grooves is used as said one of the rolling rolls to form in upper edges of the ridges approximately semicircular cutouts arranged at the predetermined spacing and providing communication holes for causing the parallel refrigerant passages to communicate with one another therethrough.

* * * * *